US010991503B2

(12) United States Patent
Lin

(10) Patent No.: US 10,991,503 B2
(45) Date of Patent: Apr. 27, 2021

(54) METHOD OF FABRICATING AN INDUCTOR

(71) Applicant: Realtek Semiconductor Corp., Hsinchu (TW)

(72) Inventor: Chia-Liang (Leon) Lin, Fremont, CA (US)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 290 days.

(21) Appl. No.: 16/043,314

(22) Filed: Jul. 24, 2018

(65) Prior Publication Data

US 2020/0035400 A1 Jan. 30, 2020

(51) Int. Cl.

| | |
|---|---|
| ***H01F 7/06*** | (2006.01) |
| ***H01F 27/28*** | (2006.01) |
| ***H01F 17/00*** | (2006.01) |
| ***H01F 41/04*** | (2006.01) |

(52) U.S. Cl.

CPC ..... *H01F 27/2804* (2013.01); *H01F 17/0013* (2013.01); *H01F 41/04* (2013.01); *H01F 2017/002* (2013.01); *H01F 2027/2809* (2013.01)

(58) Field of Classification Search

CPC .... H01F 17/0013; H01F 41/04; H01F 41/041; H01F 27/2804; H01F 2017/002; H01F 2017/008; H01F 2027/2809

See application file for complete search history.

(56) References Cited

U.S. PATENT DOCUMENTS

| | | | | |
|---|---|---|---|---|
| 4,044,394 | A * | 8/1977 | Hanazono | G11B 5/313 360/123.01 |
| 6,480,086 | B1 * | 11/2002 | Kluge | H01F 17/0013 257/E21.022 |
| 6,498,555 | B1 * | 12/2002 | Sakata | H01F 17/0013 336/200 |
| 7,151,298 | B1 * | 12/2006 | Eggert | H01L 23/60 257/355 |
| 7,786,836 | B2 * | 8/2010 | Gabara | H01F 17/0006 336/200 |
| 7,796,006 | B2 * | 9/2010 | Chen | H01F 17/0013 336/200 |
| 9,697,938 | B2 * | 7/2017 | Yan | H01F 41/041 |
| 2004/0149387 | A1 * | 8/2004 | Kim | H01J 37/321 156/345.48 |
| 2016/0276092 | A1 * | 9/2016 | Zhang | H05K 1/0233 |
| 2019/0089304 | A1 * | 3/2019 | Moslehi Bajestan | H01F 21/12 |

* cited by examiner

*Primary Examiner* — Paul D Kim

(74) *Attorney, Agent, or Firm* — McClure, Qualey & Rodack, LLP

(57) ABSTRACT

An inductor is laid out on a multi-layer structure, the inductor having a multi-turn coil including a plurality of metal traces laid out on at least two metal layers and a plurality of vias configured to provide inter-layer connection, wherein the multi-turn coil includes a first half configured to conduct a current flow between a first end and a center tap and a second half configured to conduct a current flow between a second end and the center tap; and an additional metal laid out on a metal layer below a lowest metal layer of the multi-turn coil, wherein the additional metal is laid out beneath the first half if the second half has a greater parasitic capacitance, or alternatively beneath the second half if the first half has a greater parasitic capacitance.

5 Claims, 5 Drawing Sheets

METHOD OF FABRICATING AN INDUCTOR

BACKGROUND OF THE DISCLOSURE

Field of the Disclosure

The present disclosure generally relates to inductors and more specifically to multi-turn inductors having a balanced response.

Description of Related Art

Inductors are widely used in radio transceivers. An inductor usually comprises multiple turns. A layout of a prior art two-turn inductor 100 is shown in FIG. 1. A top view is shown in box 100TV. A side view is shown in box 100SV. A legend is shown in box 100LG. Inductor 100 is constructed in a multi-layer structure laid out upon a substrate 160. Inductor 100 comprises: a first metal trace 111 laid out on a first metal layer M7; a second metal trace 112 laid out on the first metal layer M7; an underpass metal trace 120 laid out on a second metal trace M6; a first via connecting the first metal trace 111 with one end of the underpass metal trace 120; a second via connecting the second metal trace 112 with the other end of the underpass metal trace 120; and a patterned ground shield (PGS) 140 laid out on a third metal trace M1. The multi-layer structure is embedded in a dielectric medium 150.

An issue of the two-turn inductor 100 is: due to using the underpass metal trace 120 along with the first via 131 and the second via 132, the two-turn inductor 100 is typically unbalanced. This can degrade performance of an application circuit that uses the two-turn inductor 100. For instance, it may deteriorate a second order distortion of an amplifier that uses the two-turn inductor 100 as a load.

What is desired is a structure and fabrication method to alleviate an effect of imbalance of a multi-turn inductor.

SUMMARY OF THE DISCLOSURE

In an embodiment, an inductor is laid out on a multi-layer structure comprising: a multi-turn coil including a plurality of metal traces laid out on at least two metal layers and a plurality of vias configured to provide inter-layer connection, wherein the multi-turn coil comprises a first half configured to conduct a current flow between a first end and a center tap and a second half configured to conduct a current flow between a second end and the center tap; and an additional metal laid out on a metal layer below a lowest metal layer of the multi-turn coil, wherein the additional metal is laid out beneath the first half only if the second half has a greater parasitic capacitance, and the additional metal layer is laid out beneath the second half only if the first half has a greater parasitic capacitance.

In an embodiment, a method of fabricating an inductor comprises: laying out a multi-turn coil on a multi-layer structure using a plurality of metal traces laid out on at least two metal layers and a plurality of vias configured to provide inter-layer connection, wherein the multi-turn coils comprises a first half configured to conduct a current flow between a first end and a center tap and a second half configured to conduct a current flow between a second end and the center tap; identifying whether the first half has a greater parasitic capacitance than the second half; and laying out an additional metal on a metal layer below a lowest metal layer of the multi-turn coil beneath the first half only if the second half has the greater parasitic capacitance, and laying out the additional metal on the metal layer below a lowest metal layer of the multi-turn core beneath the second half only if the first half has the greater parasitic capacitance.

DETAILED DESCRIPTION OF THIS DISCLOSURE

The present disclosure is directed to inductors. While the specification describes several example embodiments of the disclosure considered favorable modes of practicing the invention, it should be understood that the invention can be implemented in many ways and is not limited to the particular examples described below or to the particular manner in which any features of such examples are implemented. In other instances, well-known details are not shown or described to avoid obscuring aspects of the disclosure.

Figure 1:
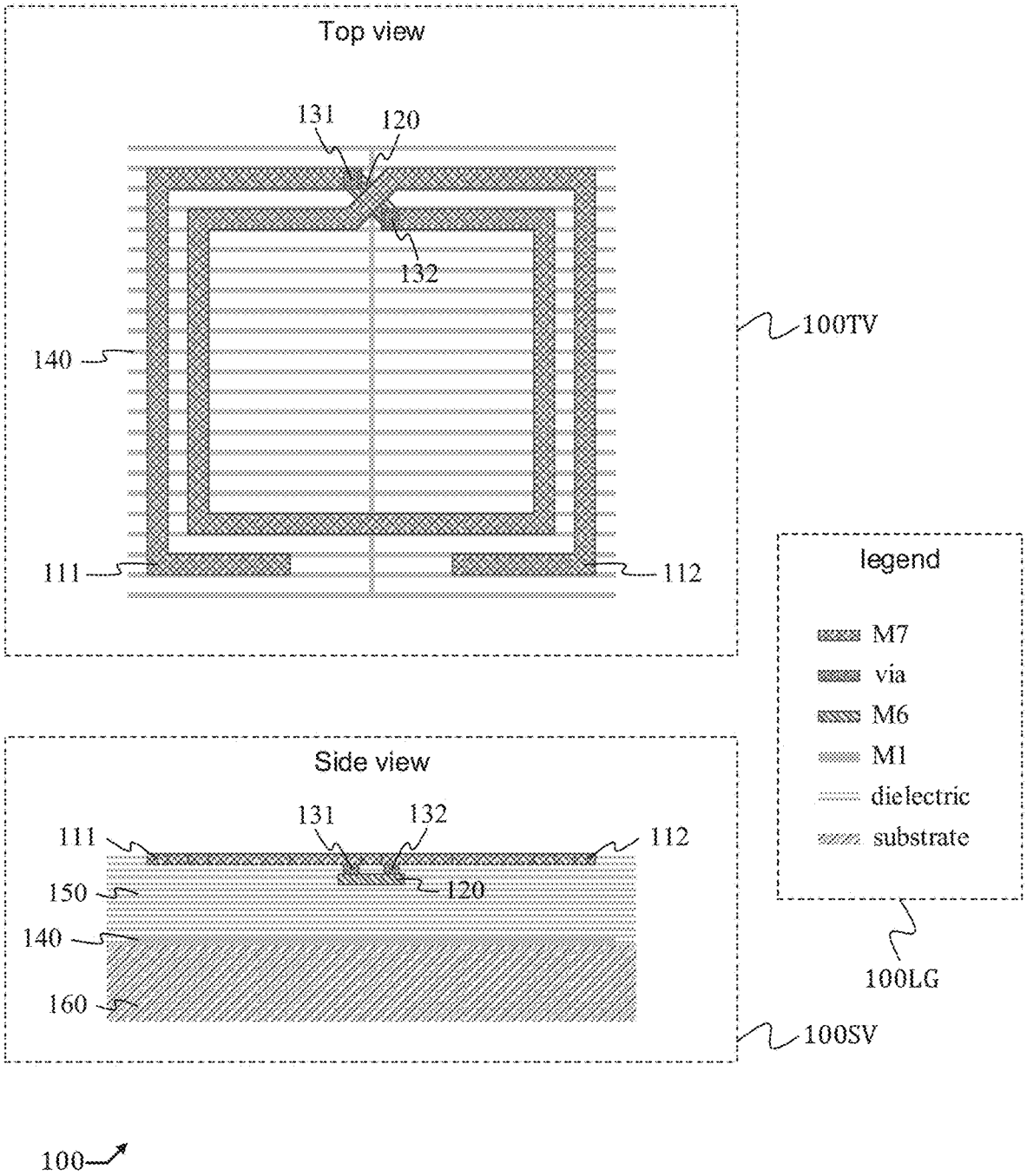
FIG. 1 (PRIOR ART)
FIG. 1 shows a layout of a prior art two-turn inductor.
Figure 2A:
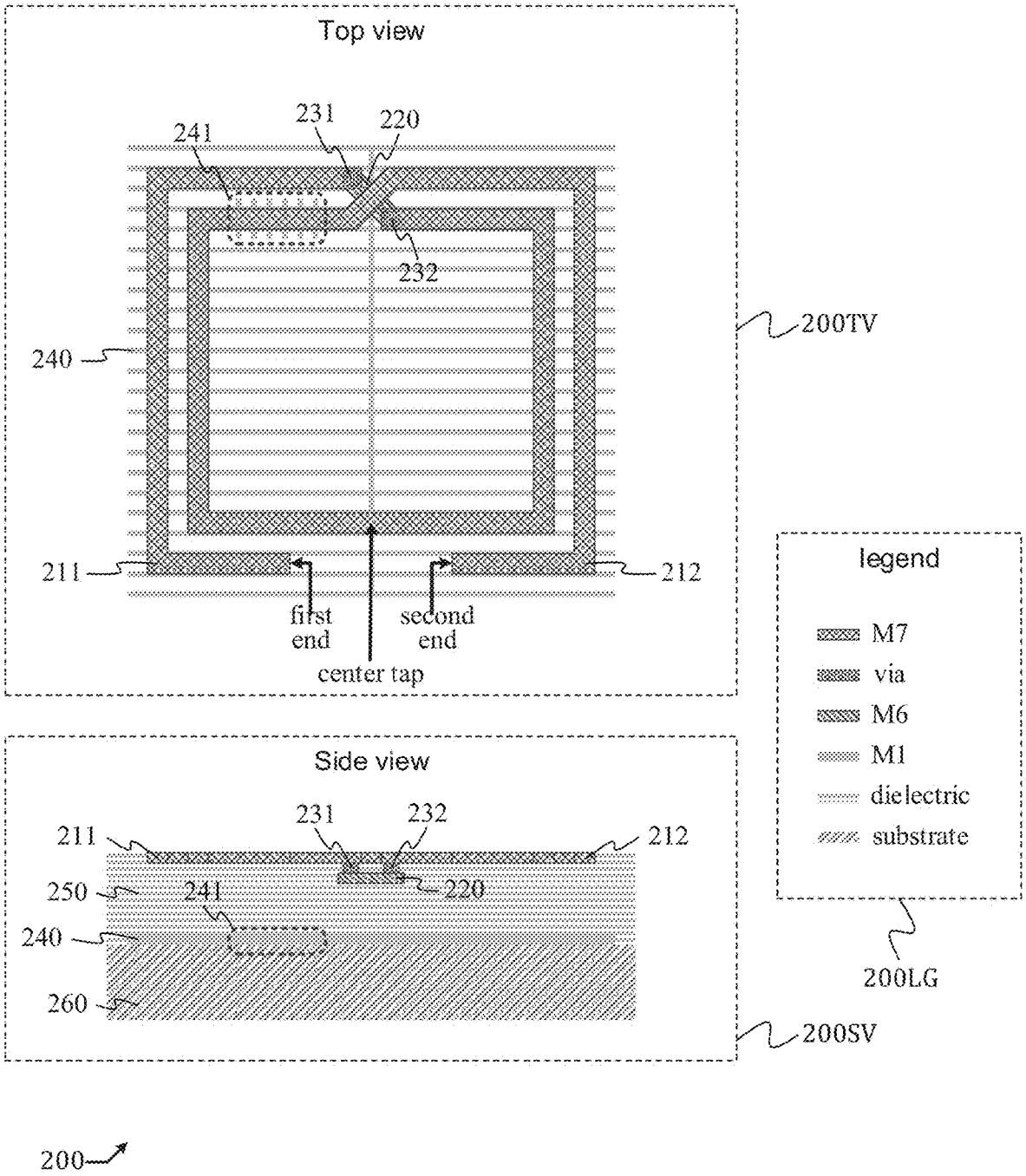
FIG. 2A shows a layout of a two-turn inductor in accordance with an embodiment of the present invention.

An objective of the present invention is to alleviate an effect of imbalance of a multi-turn inductor. A two-turn inductor is used as an example, while the same principle can be applied to an inductor that has more than two turns. A layout of a two-turn inductor 200 in accordance with an embodiment of the present invention is shown in FIG. 2A. A top view is shown in box 200TV. A side view is shown in box 200SV. A legend is shown in box 200LG. Inductor 200 is constructed in a multi-layer structure laid out on top of a substrate 260. Inductor 200 comprises: a first metal trace 211 laid out on a first metal layer M7; a second metal trace 212 laid out on the first metal layer M7; an underpass metal trace 220 laid out on a second metal trace M6; a first via 231 connecting the first metal trace 211 with one end of the underpass metal trace 220; a second via 232 connecting the second metal trace 212 with the other end of the underpass metal trace 220; and a patterned ground shield (PGS) 240 laid out on a third metal layer M1. The multi-layer structure is embedded in a dielectric medium 250. The two-turn inductor 200 of FIG. 2A is the same as the prior art two-turn inductor 100 of FIG. 1 except that, PGS 240 is deliberately made unbalanced to make the overall response of inductor more balanced by including additional metals as shown inside box 241 added to a left side of the PGS 240. There is an underpass parasitic capacitance between the underpass metal trace 220 and the PGS 240. A current flowing from a first end to a second end will see the underpass parasitic capacitance before passing a center tap, while a current flowing from the second end to the first end will see the underpass parasitic capacitance after passing the center tap. The additional metal inside box 241 introduces an additional parasitic capacitance between the second metal trace 212 and the additional metal inside box 241. The current flowing from the first end to the second end will see the additional parasitic capacitance after passing the center tap, while the current flowing from the second end to the first end will see the additional parasitic capacitance before passing the center tap. The imbalance caused by the parasitic capacitance of the underpass metal trace 220 thus can be offset by the parasitic capacitance of the additional metal inside box 241. The overall frequency response of inductor thus can be more balanced.

Note that the first metal trace 211, the first via 231, the underpass metal trace 220, the second via 232, and the second metal trace 212 form a two-turn coil that allows a current flowing from the first end to the second end, and vice versa. A current flow between the first end and the second end will always pass through the center tap. The two-turn coil, therefore, can be divided into a first half and a second half, wherein a current flow between the first end and the center tap is conducted on the first half, while a current flow between the second end and the center tap is conducted on the second half. The first half has a greater parasitic capacitance than the second half due to the underpass metal trace 220, therefore the additional metals inside box 241 are laid out beneath the second half to introduce an additional parasitic capacitance to balance it out.

Figure 2B:
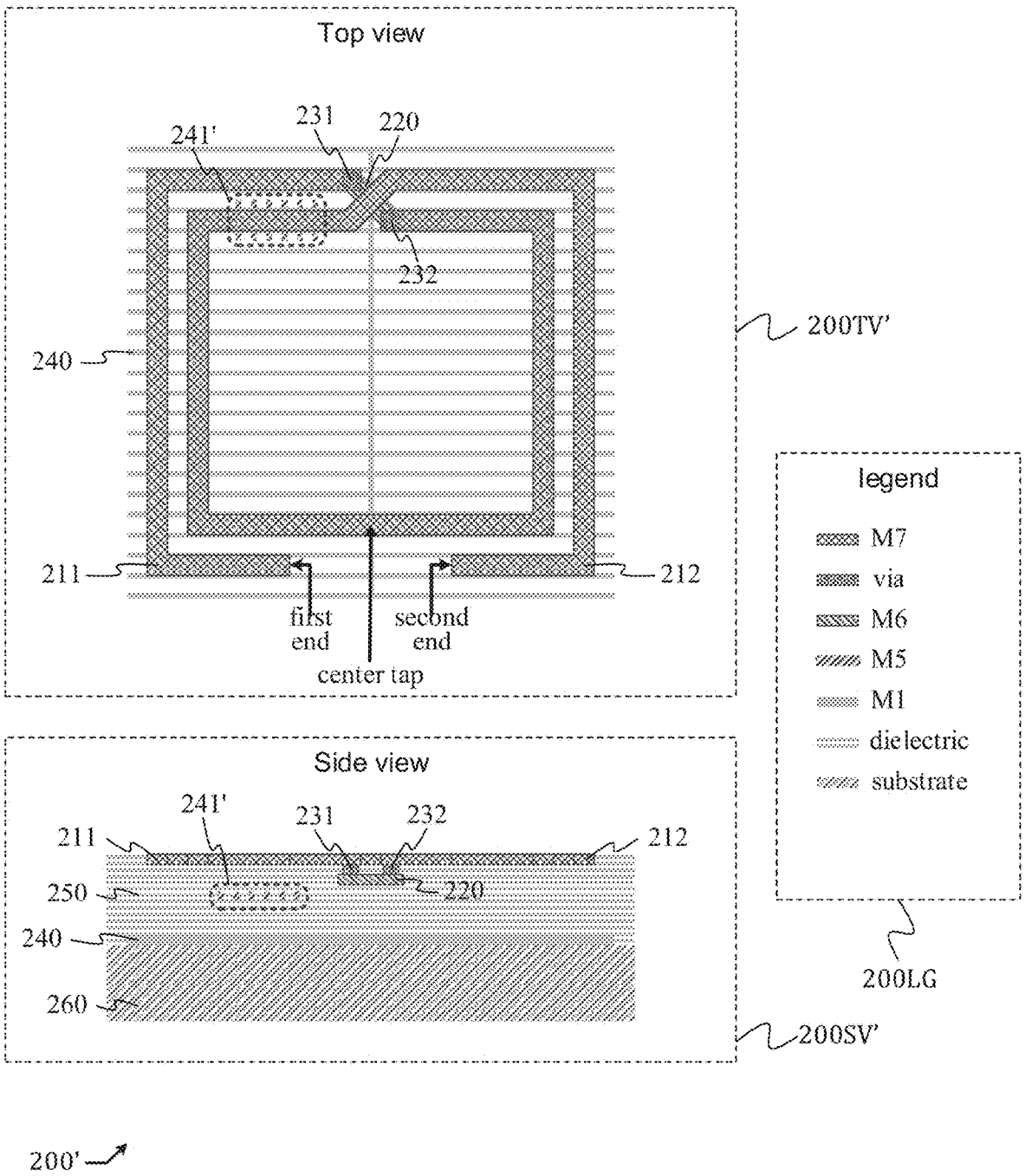
FIG. 2B shows a layout of a two-turn inductor in accordance with an alternative embodiment of the present invention.

A layout of a two-turn inductor 200' in accordance with an alternative embodiment is shown in FIG. 2B. A top view is shown in box 200TV'. A side view is shown in box 200SV'. A legend is shown in box 200LG'. The two-turn inductor 200' in FIG. 2B is the same as the two-turn inductor 200 in FIG. 2A, except that the additional metals inside box 241 in FIG. 2A are replaced by alternative additional metal inside box 241'. The alternative additional metals inside box 241' are laid out on a fourth metal layer M5, instead of the third metal layer M1. This embodiment can provide a larger additional parasitic capacitance, since a distance between metal layer M5 and metal layer M6 is smaller than a distance between metal layer M1 and metal layer M6.

Figure 3:
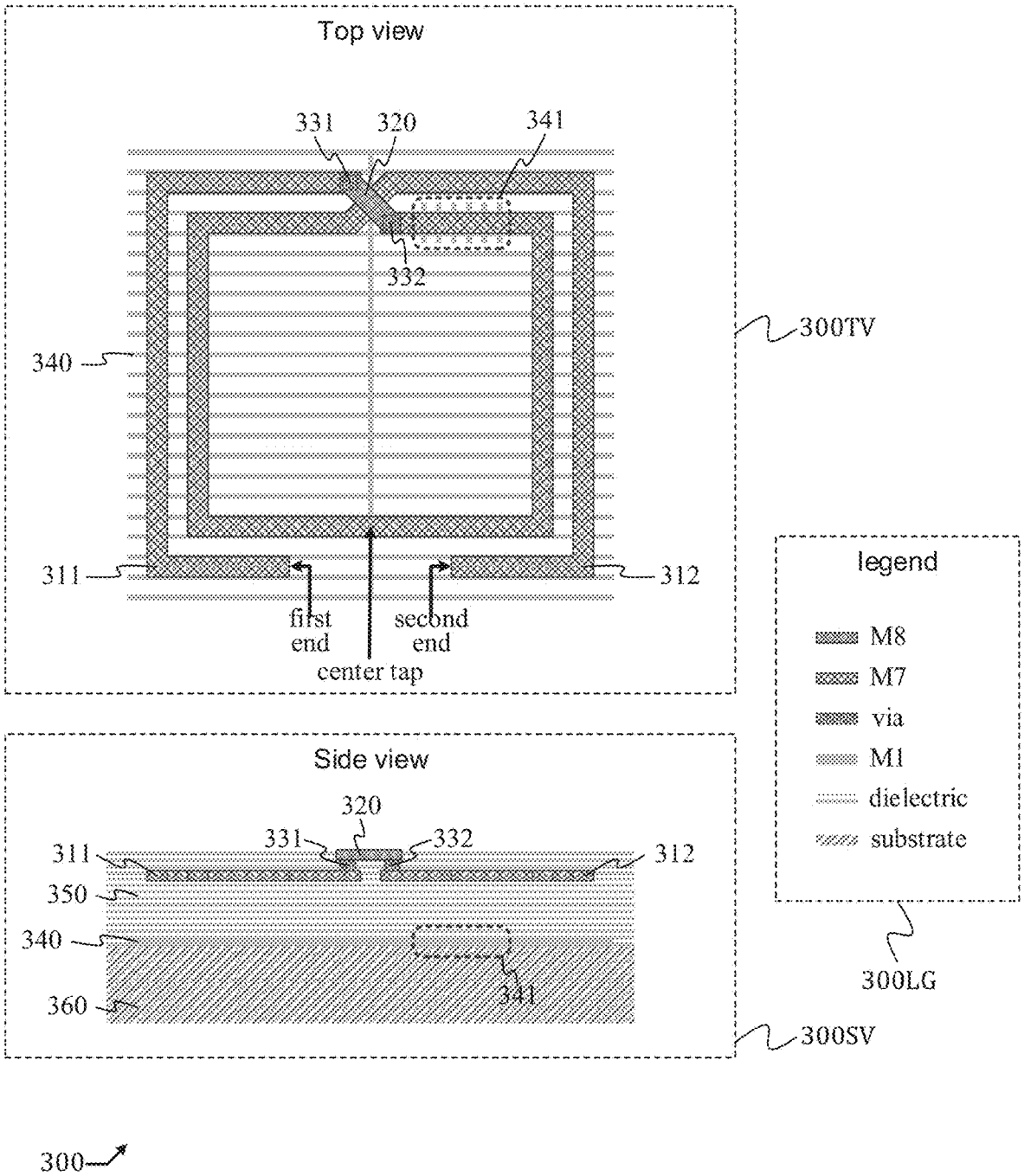
FIG. 3 shows a layout of a two-turn inductor in accordance with a yet alternative embodiment of the present invention.

A layout of a two-turn inductor 300 in accordance with another alternative embodiment is shown in FIG. 3. A top view is shown in box 300TV. A side view is shown in box 300SV. A legend is shown in box 300LG. Inductor 300 is constructed in a multi-layer structure laid out upon a substrate 360. Inductor 300 comprises: a first metal trace 311 laid out on metal layer M7; a second metal trace 312 laid out on metal layer M7; an overpass metal trace 320 laid out on a fifth metal trace M8; a first via 331 connecting the first metal trace 311 with one end of the overpass metal trace 320; a second via 332 connecting the second metal trace 312 with the other end of the overpass metal trace 320; and a patterned ground shield (PGS) 340 laid out on metal layer M1. The multi-layer structure is embedded in a dielectric medium 350. The two-turn inductor 300 is the same as the two-turn inductor 200 of FIG. 2A except for two differences: first, the underpass metal trace 220 on metal layer M6 is replaced with the overpass metal trace 320 on metal layer M8; second, additional metal as shown inside box 341 is added to a right side of the PGS 340 (as opposed to having additional metals inside box 241 added to the left side of the PGS 240). The overpass metal trace 320 has a smaller parasitic capacitance, compared to the rest of the path of the inductor's current flow. A current flowing from the first end to the second end will see the lesser, overpass parasitic capacitance before passing the center tap, while a current flowing from the second end to the first end will see the lesser, overpass parasitic capacitance after passing the center tap. The additional metal inside box 341 introduces an additional parasitic capacitance between the second metal trace 312 and the additional metals inside box 341. The current flowing from the first end to the second end will see the additional parasitic capacitance before passing the center tap, while the current flowing from the second end to the first end will see the additional parasitic capacitance after passing the center tap. The imbalance caused by the lesser parasitic capacitance of the overpass metal trace 320 thus can be offset by the parasitic capacitance of the additional metals inside box 341. The overall response of inductor thus can be more balanced.

In an alternative embodiment not shown in figure, the additional metals inside box 341 are laid out on metal layer M6 (see FIG. 2B).

This present invention can be applied to inductors of more than two turns. A key is to identify an imbalance of a multi-turn coil due to a crossover. A multi-turn coil has a first end, a second end, and a center tap, and can be divided into a first half and a second half in accordance with the center tap, wherein a current flow between the first end and the center tap is conducted by the first half, while a current flow between the second end and the center tap is conducted by the second half. If the first half of the multi-turn coil has a greater (lesser) parasitic capacitance than the second half of the multi-turn coil, an additional metal is added beneath the second (first) half to introduce an additional parasitic capacitance to offset the difference of parasitic capacitance between the first half and the second half.

Figure 4:
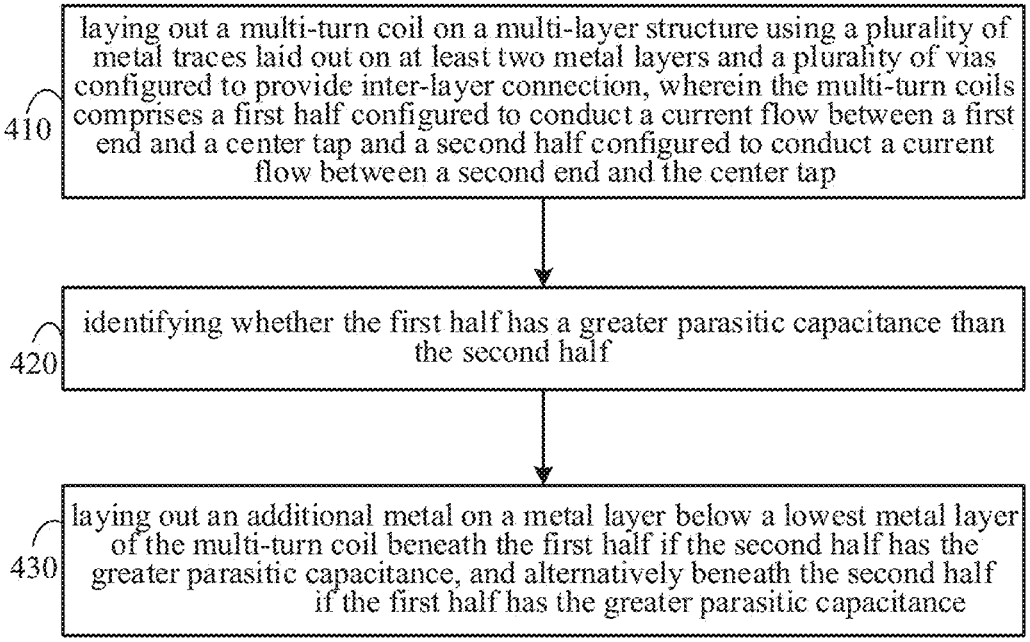
FIG. 4 shows a flow diagram of a method in accordance with an embodiment of the present invention.

As shown by a flow diagram 400 in FIG. 4, a method in accordance with an embodiment of the present invention comprises: (step 410) laying out a multi-turn coil on a multi-layer structure using a plurality of metal traces laid out on at least two metal layers and a plurality of vias configured to conduct inter-layer connection, wherein the multi-turn coils comprises a first half configured to conduct a current flow between a first end and a center tap and a second half configured to conduct a current flow between a second end and the center tap; (step 420) identifying whether the first half has a greater parasitic capacitance than the second half; and (step 430) laying out an additional metal on a metal layer below a lowest metal layer of the multi-turn coil beneath the first half, if the second half has the greater parasitic capacitance, and alternatively beneath the second half if the first half has the greater parasitic capacitance.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A method of fabricating an inductor comprising:

laying out a multi-turn coil on a multi-layer structure using a plurality of metal traces laid out on at least two metal layers and a plurality of vias configured to provide inter-layer connection, wherein the multi-turn coils comprises a first half configured to conduct a current flow between a first end and a center tap and a second half configured to conduct a current flow between a second end and the center tap;

identifying whether the first half has a greater parasitic capacitance than the second half;

laying out an additional metal on a metal layer below a lowest metal layer of the multi-turn coil beneath the first half only if the second half has the greater parasitic capacitance; and laying out the additional metal on a metal layer below a lowest metal layer of the multi-turn core beneath the second half only if the first half has the greater parasitic capacitance.

2. The method of claim 1, wherein the multi-turn coil comprises a first metal trace and a second metal trace laid out on a first metal layer, a third metal trace laid out on a second metal layer, a first via configured to connect one end of the third metal trace to the first metal trace, and a second via configured to connect another end of the third metal trace to the second metal trace.

3. The method of claim 2 further comprising laying out a patterned ground shield laid out on a third metal layer that is below a lowest metal layer of the multi-turn coil.

4. The method of claim 3, wherein the additional metal is laid out on the third metal layer.

5. The method of claim 3, wherein the additional metal is laid out on a fourth metal layer between the third metal layer and the lowest metal layer of the multi-turn coil.

* * * * *